US012325554B2

(12) United States Patent
Nguyen et al.

(10) Patent No.: US 12,325,554 B2
(45) Date of Patent: Jun. 10, 2025

(54) BOTTLE WITH ENHANCED GRIPPING FACETS

(71) Applicant: Illinois Tool Works Inc., Glenview, IL (US)

(72) Inventors: Tu D. Nguyen, Glenview, IL (US); Chi Quang Nguyen, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/864,628

(22) Filed: Jul. 14, 2022

(65) Prior Publication Data

US 2023/0014914 A1 Jan. 19, 2023

Related U.S. Application Data

(60) Provisional application No. 63/222,142, filed on Jul. 15, 2021.

(51) Int. Cl.

*B65D 23/10* (2006.01)
*B65D 1/02* (2006.01)
*B65D 1/40* (2006.01)

(52) U.S. Cl.

CPC ..... *B65D 23/102* (2013.01); *B65D 1/0207* (2013.01); *B65D 1/0223* (2013.01); *B65D 1/40* (2013.01); *B65D 2203/00* (2013.01); *B65D 2501/0081* (2013.01)

(58) Field of Classification Search

CPC ..... B65D 1/0223; B65D 1/0207; B65D 1/40; B65D 2203/00; B65D 23/102

See application file for complete search history.

(56) References Cited

U.S. PATENT DOCUMENTS 4,890,752 A * 1/1990 Ota ..... B65D 1/0223 220/675
5,199,587 A * 4/1993 Ota ..... B29C 33/005 215/381

(Continued)

FOREIGN PATENT DOCUMENTS

CA 3028981 A1 1/2018
NL 2023339 B1 12/2020

OTHER PUBLICATIONS

Int'l Search Report for PCT/US2022/037079, dated Oct. 26, 2022.

*Primary Examiner* — Nathan J Jenness
*Assistant Examiner* — Jennifer Castriotta
(74) *Attorney, Agent, or Firm* — MaxGoLaw PLLC

(57) ABSTRACT

A thermoplastic bottle is provided that has a sidewall having an exterior surface that defines a plane curve. The sidewall is joined with a base and a mouth to define an interior volume. Facets are integrally formed in the sidewall that each have a recess interior to the plane curve and a protrusion extending above the recess. The protrusion being either above or below the plane curve. The recess can surround the protrusion or be adjacent thereto. Facets can be arranged in a variety of patterns and vary in shape, size, or both relative to one another. A ratio is defined for a recess depth to an absolute value of a height of a protrusion of 0.2-5:1. The resulting bottle offers a better grip when fluid bottle contents have dripped on the exterior surface relative to a conventional bottle. By allowing the drippage to seep into recesses of the facets.

19 Claims, 6 Drawing Sheets

(56) References Cited

U.S. PATENT DOCUMENTS

| | | | | | |
|---|---|---|---|---|---|
| 5,407,086 | A * | 4/1995 | Ota | B65D 1/0223 | 220/675 |
| D359,237 | S * | 6/1995 | Nakamura | D9/570 | |
| 5,632,397 | A * | 5/1997 | Fandeux | B65D 1/0292 | 220/666 |
| 5,690,244 | A * | 11/1997 | Darr | B65D 1/0223 | 220/675 |
| 5,704,503 | A * | 1/1998 | Krishnakumar | B65D 1/0223 | 215/381 |
| D393,210 | S * | 4/1998 | Ewing, Jr. | D9/569 | |
| 6,044,996 | A * | 4/2000 | Carew | B65D 1/0223 | 215/381 |
| 6,494,333 | B2 * | 12/2002 | Sasaki | B65D 79/0084 | 215/381 |
| 6,739,467 | B2 * | 5/2004 | Saito | B65D 23/102 | 215/379 |
| 6,827,228 | B2 * | 12/2004 | Headen | B65D 1/40 | 220/675 |
| 7,213,719 | B2 * | 5/2007 | Pedmo | B65D 79/0084 | 215/381 |
| D644,114 | S * | 8/2011 | Williams | D9/554 | |
| 9,150,331 | B2 * | 10/2015 | Kisela | B65D 81/3837 | |
| 2003/0010744 | A1 * | 1/2003 | Ma | B65D 1/0223 | 215/382 |
| 2008/0308442 | A1 | 12/2008 | Spigelman et al. | | |
| 2012/0091124 | A1 * | 4/2012 | Frisch | B65D 81/3453 | 220/592.01 |

* cited by examiner

BOTTLE WITH ENHANCED GRIPPING FACETS

RELATED APPLICATIONS

This application is a non-provisional application that claims priority benefit of US Provisional Application Ser. No. 63/222,142 filed on Jul. 15, 2021; the contents of which are hereby incorporated by reference.

FIELD OF THE INVENTION

The present invention in general relates to a bottle, and in particular to a plastic bottle with enhanced gripping facets integrally formed into an exterior surface of the bottle.

BACKGROUND OF THE INVENTION

Bottles are a popular product packaging container for liquid products. They can securely store and also efficiently dispense a liquid product contained therein. Bottles also offer flexibility in packaging shape and design. They are easily tailored to meet specific storage and dispense parameters of a given product, and also to meet brand recognition and advertising design parameters. While there are many benefits to the use of a bottle as a product packaging container, there are also disadvantages. For example, from a retail sales perspective, popularity of the bottle as a product packaging container presents a problem as to how to differentiate bottle-packaged product for a consumer amongst numerous similarly bottle-packaged product alternatives, especially in a retail store context where a product sits on a shelf in a store surrounded by numerous similarly bottle-packaged products.

In the field of vehicle maintenance products, a consumer generally has a variety of retail options for each specific vehicle maintenance product illustratively including windshield wiper fluid, exterior body waxes and polishes, tire cleaners, and interior cleaning solutions. A consumer can become easily overwhelmed and experience decision fatigue when attempting to choose from the numerous available options for the same vehicle maintenance product. This decision fatigue can be experienced both during online shopping and when shopping in a physical retail store. In fact, decision fatigue can be exacerbated when a consumer is shopping in a physical retail store. A consumer standing in front of a shelf with the numerous available product options arranged next to each other may find it difficult to discern the slight (or nonexistent) variations between the different brands and may start to feel overwhelmed. Decision fatigue produces negative consequences for both the seller of the product and the consumer. Often, a consumer experiencing decision fatigue will simply randomly select a vehicle maintenance product off the shelf in order to terminate the discomfort of decision fatigue. In this scenario, if the seller indeed is selling a superior product relative to other available alternative, the consumer is negatively affected because the consumer would benefit from purchase and use of the superior product. The seller is negatively affected because the reflexive random choice made by the consumer contributes to lost profit for the retailer. One solution to this problem is through resort to a uniquely designed bottle that establishes brand recognition and differentiates it from other available alternatives, allowing consumers to easily recognize the product on a shelf in a retail store and also amongst on array of product images in the context of online shopping. Through marketing and consumer experience (i.e. when a consumer has already experienced instances of decision fatigue induced random choice and, based on prior use of a specific product, forms a conclusive opinion as to the superiority of the specific product relative to available alternatives), a unique bottle packaging design establishes brand recognition and allows a product to stand out from "the pack", making it easier for a consumer to remember positive instances of previous product use, and making it easier for a consumer to quickly locate the product when presented with a variety of product alternatives. This helps to mitigate consumer decision fatigue and encourage consumers to purchase the uniquely designed bottle, helping sellers to capture further profit that may otherwise be lost when a conventionally designed bottle is used for product packaging.

In addition to the brand recognition problem described above, bottles present another problem from a utility perspective. A typical bottle has a smooth exterior that makes gripping difficult, especially when a lubricious content is spilled on the bottle exterior. This negatively affects the seller, as a consumer experiencing product loss as a result of poor grip develops a negative association with the product. As many vehicle maintenance products are oily in nature and regularly handled in the context of vehicle maintenance, the grip concerns and the likelihood of an unpleasant spill cleanup are considerable.

There are many prior art solutions directed toward bottle grip improvement and unique design. However, these solutions remain lacking. In general, prior art solutions fail to achieve a desired nexus between both grip enhancement and product differentiation where the grip enhancement itself also provides the beneficial product differentiation. Additionally, many prior art solutions are directed toward enhancing grip via bottle shape or via application of additional gripping facets onto an already produced bottle and are thus lacking in an enhanced grip solution that can be adopted regardless of bottle shape.

Thus, there exists a need for a bottle with an enhanced grip solution integral with the bottle regardless of bottle shape that also contributes to brand recognition and differentiates a product contained within bottle from other alternative product options.

SUMMARY OF THE INVENTION

A thermoplastic bottle is provided that has a sidewall having an exterior surface that defines a plane curve. The sidewall is joined with a base and a selectively sealable mouth to define an interior volume. Facets are integrally formed in the sidewall that each have a recess interior to the plane curve and a protrusion extending above the recess. The protrusion being either above or below the plane curve. The recess can surround the protrusion or be adjacent thereto. Facets can be arranged in a variety of patterns and vary in shape, size, or both relative to one another. A ratio is defined for a recess depth to an absolute value of a height of a protrusion of 0.2-5:1.

The resulting bottle offers a better grip when fluid bottle contents have dripped on the exterior surface relative to a conventional bottle. By allowing the drippage to seep into recesses of the facets.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION OF THE INVENTION

Figure 1:
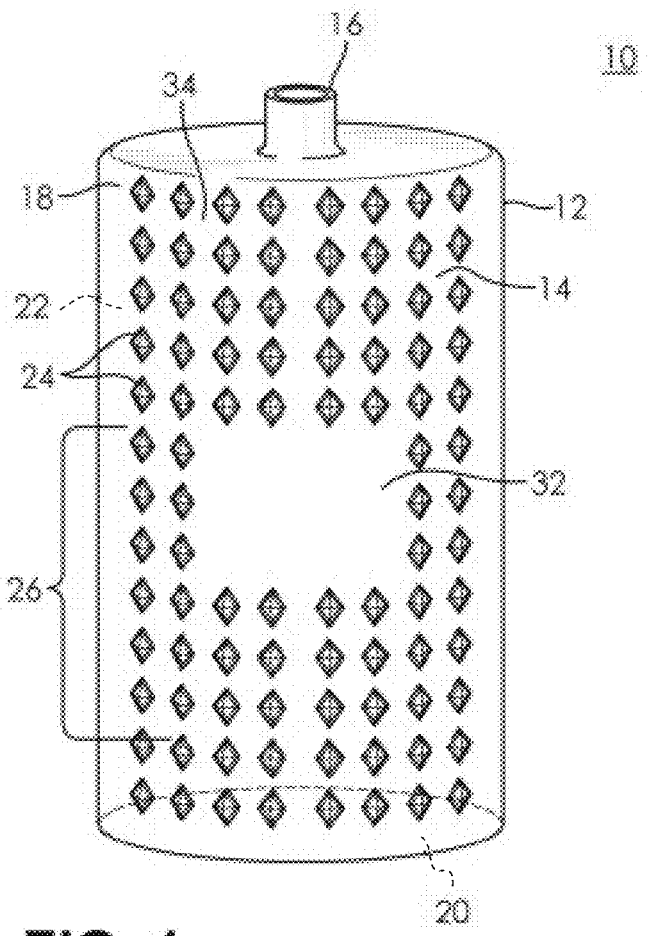
FIG. 1 is a perspective view of an inventive bottle with nonadjacent discrete gripping facets integrally formed into an exterior surface of the bottle as a space filling array on a portion of the exterior surface.

The present invention has utility as a bottle with an enhanced gripping facets. An inventive bottle with features integral to the bottle sidewall and simultaneously recessed and protruding from a plane cure of the sidewall is uniquely identifiable relative to conventional bottles while enhancing the ability for a user to apply a fast grip thereto. Resort to the inventive facets creates a greater surface area that creates recesses in which drippage tends to pool thereby rendering the bottle easier to grip. The inventive facets are also noted to increase surface area of the inventive bottle with limited profile deviations from the sidewall center that promotes high throughput injection molding of inventive bottles. In certain embodiments, the discrete facets define a surface filling array that is brand-identifiable while promoting firm grip of the inventive bottle by a user.

In this disclosure, "comprises," "comprising," "containing" and "having" and the like can have the meaning ascribed to them in U.S. Patent law and can mean "includes," "including," and the like; "consisting essentially of" or "consists essentially" likewise has the meaning ascribed in U.S. Patent law and the term is open-ended, allowing for the presence of more than that which is recited so long as basic or novel characteristics of that which is recited is not changed by the presence of more than that which is recited, but excludes prior art embodiments.

It is to be understood that in instances where a range of values are provided that the range is intended to encompass not only the end point values of the range but also intermediate values of the range as explicitly being included within the range and varying by the last significant figure of the range. By way of example, a recited range from 1 to 4 is intended to include 1-2, 1-3, 2-4, 3-4, and 1-4. Furthermore, ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9 being between 1 and 2. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "or" is understood to be inclusive. Unless specifically stated or obvious from context, as used herein, the terms "a," "an," and "the" are understood to be singular or plural.

Also, as used herein, "and/or" refers to and encompasses any and all possible combinations of one or more of the associated listed items, as well as the lack of combinations when interpreted in the alternative ("or").

As used herein, a "unit cell" is defined as the smallest repeating unit that can cover a plane curve of a bottle surface through only the operation of translation of the unit cell.

The suffix "(s)" as used herein is intended to include both the singular and the plural of the term that it modifies, thereby including one or more of that term.

Reference throughout the specification to "one embodiment," "another embodiment," "an embodiment," and so forth, when present, means that a particular element (e.g., feature, structure, and/or characteristic) described in connection with the embodiment is included in at least one embodiment described herein, and may or may not be present in other embodiments. In addition, it is to be understood that the described facets may be combined in any suitable.

In some inventive embodiments, discrete facets are each independently in one of a variety of shapes. In certain embodiments, at least two of discrete facets are contiguous. In other embodiments, at least two of the discrete facets are nonadjacent with a channel therebetween on a plane curve on the exterior surface of the bottle. In still other inventive embodiments, the discrete facets are either nonordered or are present in the form of indicia such as a logo, letter, or number. In still other inventive embodiments, a portion of the exterior surface is smooth and follows the plane curve of the sidewall and is independent of the discrete facets. A featureless, smooth portion is amendable to receive an adhesive label. In some inventive embodiments, the inventive bottle has a total surface area between 10 and 40 percent greater than that of a like bottle independent of the discrete facets disclosure herein. In this disclosure, "comprises," "comprising," "containing" and "having" and the like can have the meaning ascribed to them in U.S. Patent law and can mean "includes," "including," and the like; "consisting essentially of" or "consists essentially" likewise has the meaning ascribed in U.S. Patent law and the term is open-ended, allowing for the presence of more than that which is recited so long as basic or novel characteristics of that which is recited is not changed by the presence of more than that which is recited, but excludes prior art embodiments.

It is to be understood that in instances where a range of values are provided that the range is intended to encompass not only the end point values of the range but also intermediate values of the range as explicitly being included within the range and varying by the last significant figure of the range. Furthermore, ranges provided herein are understood to be shorthand for all of the values within the range. For example, a range of 1 to 50 is understood to include any number, combination of numbers, or sub-range from the group consisting of 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50, as well as all intervening decimal values between the aforementioned integers such as, for example, 1.1, 1.2, 1.3, 1.4, 1.5, 1.6, 1.7, 1.8, and 1.9. With respect to sub-ranges, "nested sub-ranges" that extend from either end point of the range are specifically contemplated. For example, a nested sub-range of an exemplary range of 1 to 50 may comprise 1 to 10, 1 to 20, 1 to 30, and 1 to 40 in one direction, or 50 to 40, 50 to 30, 50 to 20, and 50 to 10 in the other direction.

Unless specifically stated or obvious from context, as used herein, the term "or" understood to be inclusive. Unless specifically stated or obvious from context, as used herein, the terms "a," "an," and "the" are understood to be singular or plural.

Also, as used herein, "and/or" refers to and encompasses any and all possible combinations of one or more of the associated listed items, as well as the lack of combinations when interpreted in the alternative ("or").

As used herein, a "unit cell" is defined as the smallest repeating unit that can cover a plane curve of a bottle surface through only the operation of translation of the unit cell.

The suffix "(s)" as used herein is intended to include both the singular and the plural of the term that it modifies, thereby including one or more of that term.

Reference throughout the specification to "one embodiment", "another embodiment", "an embodiment", and so forth, when present, means that a particular element (e.g., feature, structure, and/or characteristic) described in connection with the embodiment is included in at least one embodiment described herein, and may or may not be present in other embodiments. In addition, it is to be understood that the described facets may be combined in any suitable.

According the present invention, a bottle is clear, transparent, translucent, or opaque; and is formed from a thermoplastic material. Thermoplastic materials operative herein illustratively include acrylic or polymethyl methacrylate (PMMA), polycarbonate (PC), polyethylene (PE), polypropylene (PP), polyethylene terephthalate (PET), polyvinyl chloride (PVC), acrylonitrile-butadiene-styrene (ABS), and graft copolymers containing at least 50% by mass of at least one of the recited thermoplastics. In certain embodiments, the thermoplastic material has a flexural modulus of between 0.1 and 10.0 GPa imparting further enhanced grip to the inventive bottle.

An inventive bottle is formed through injection blow molding, extrusion blow molding, one-step injection molding, two-step injection molding, stretch blow molding, or a multi-layer co-extrusion.

Figure 3A:
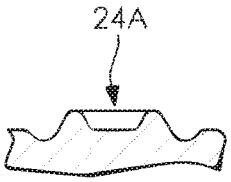
FIGS. 3A-3I, and 3L are cross-sectional views various shapes of discrete facets in accordance with embodiments of the invention.
Figure 3B:
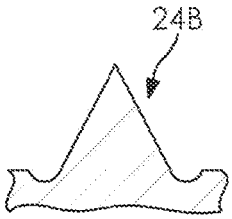
Figure 3C:
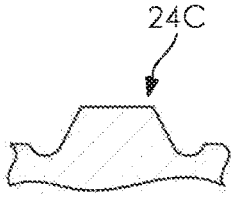
Figure 3D:
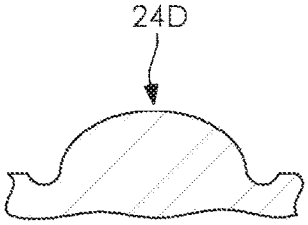
Figure 3E:
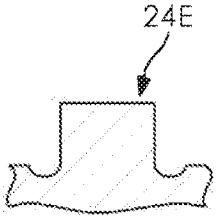
Figure 3F:
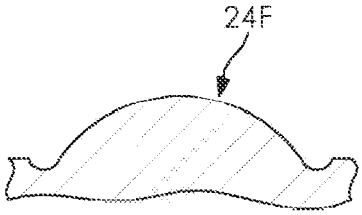
Figure 3G:
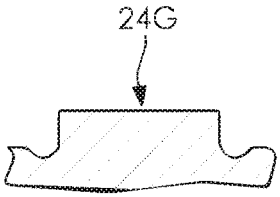
Figure 3H:
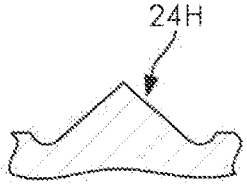
Figure 3I:
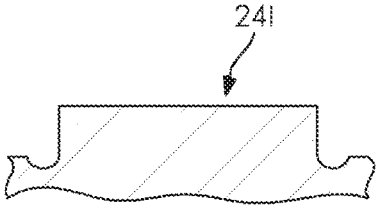
Figure 3J:
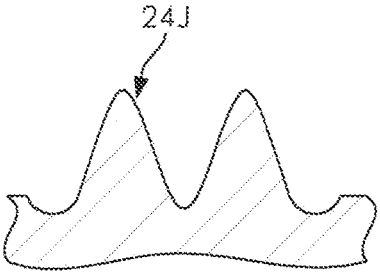
FIG. 3J is a cross-sectional views of a continuous facet surface decoration in accordance with an embodiment of the invention.
Figure 3K:
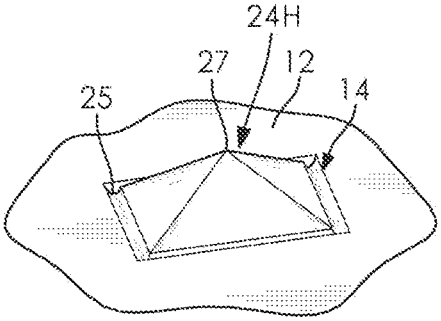
FIG. 3K is an elevated perspective view of the square pyramidal shape depicted in FIG. 3H with relative dimensions modified for visual clarity.
Figure 3L:
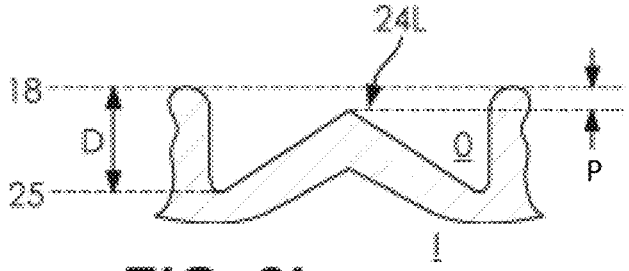

A bottle or other article formed according to the present invention has an exterior surface decorated with facets that enhance the ability of a user to grip the bottle, even if slick with drippage, while imparting a unique trade dress to the bottle. With resort to facets that are defined by a recess below the plane curve through the enter of the bottle sidewall and a protrusion above the exterior surface of the sidewall, these attributes are imparted while limiting the aspect ratio of the bottle sidewall. The typical area covered by a given facet is between 0.9 $mm^2$ (square millimeters) and 300 $mm^2$. In some inventive embodiments, each of inventive facets has a peak height, P of between −2 and 4 mm relative to a wall curve plane, 18. The wall separates an interior volume I, from the outside, O, of the bottle. In some inventive embodiments, the depth of the recess, d is measured from the top of the wall curve plane 18 to the lowest point in the recess 25. This is shown in FIG. 3L. It is of note that the facet shown in FIG. 3K only varies from that shown in cross-section in FIG. 3L as to the height of the peak. The ratio of d relative to the absolute value of the height of the protrusion 24 is between 0.2-5:1. While in some inventive embodiments, the peak height, 24A-K is above the wall curve plane 18 is a positive value with 18 being a base point, as shown in FIGS. 3A-3K, while in other inventive embodiments, such as FIGS. 3L, and FIGS. 7-9, the peak height, 24L is below the wall curve plane 18 and therefore a negative value relative to 18. In certain embodiments, a facet alone with a periphery of exterior there around defines a unit cell. In certain embodiments, the channel of flat exterior surface separates adjacent facets. A channel typically has a width of between 10 and 25 mm. It is appreciated that such channel widths are well suited to accommodate the grasp of a normal adult hand. In some inventive embodiments, an inventive bottle has sufficient facets to yield a surface area of between 10 and 60 percent greater than a total contact surface area of a like bottle having a smooth exterior surface independent of facets. It is appreciated that thermoplastic bottle formation varies relative to glass molding as to the viscousity of the molten material. Thermoplastic forming outside the ratio provided offers limited grip improvement when the ratio is less than 0.2:1 and is difficult to achieve consistent mold fill when the ratio is above 5:1.

The present invention will now be described with reference to the following embodiments. As is apparent by these descriptions, this invention can be embodied in different forms and should not be construed as limited to the embodiments set forth herein. Rather, these embodiments are provided so that this disclosure will be thorough and complete, and will fully convey the scope of the invention to those skilled in the art. For example, features illustrated with respect to one embodiment can be incorporated into other embodiments, and features illustrated with respect to a particular embodiment may be deleted from the embodiment. In addition, numerous variations and additions to the embodiments suggested herein will be apparent to those skilled in the art in light of the instant disclosure, which do not depart from the instant invention. Hence, the following specification is intended to illustrate some particular embodiments of the invention, and not to exhaustively specify all permutations, combinations, and variations thereof.

Figure 2:
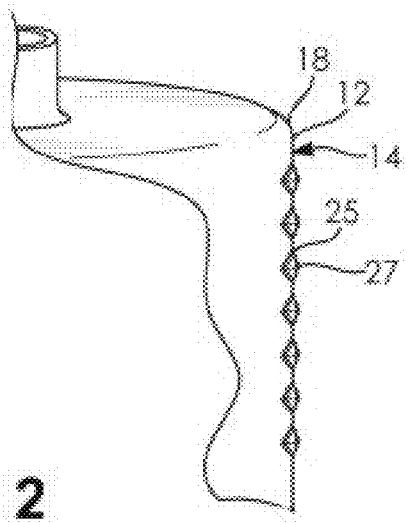
FIG. 2 is a partial cutaway view of the bottle of FIG. 1 showing the depressed and raised contours of a gripping facet relative to the bottle sidewall.

Referring now to the figures, FIG. 1 is a perspective view of an inventive bottle shown generally at 10 and FIG. 2 is a magnified partially cutaway view thereof. The bottle 10 has a sidewall 12 having an exterior surface 14 and terminating in a selectively sealable mouth 16. It is appreciated that the shape and depicted details of the bottle 10 are merely exemplary and that the inventive facets are readily formed any article shape amenable to molding by one of the aforementioned techniques. Other articles that are formed to include the inventive facets include a bottle cap and a bowl. A plane curve 18 is defined at the surface of the sidewall 12. The bottle 10 has a base 20. The base 20 and the sidewall 12 are integrally formed and define an interior volume 22. Discrete facets 24A-L are integrally formed into the sidewall 12 and each forms a recess 25 below the plane curve 18 that transitions to a protrusion 27. It is appreciated that the protrusion can also be recessed below the curve plane 18, as shown in 24L.

A portion 32 of the exterior surface 14 is smooth and independent of facets 24. It is appreciated that the portion 32 is amenable to receiving or displaying brand-identifying indicia illustratively including an adhesive label, an insignia, a logo, and the like. It is further appreciated that in certain inventive embodiments, the brand-identifying indicia is be affixed to the portion 32, while in other inventive embodiments the brand-identifying indicia is integrally formed in portion 32 during or after the molding of bottle 10. It is still further appreciated that in some inventive embodiments, the brand-identifying indicia is integrally formed with the portion 32 by embossing or debossing.

The facets 24 shown in FIGS. 1 and 2 form an array 26. A recess 25 as shown in this embodiment surrounds the periphery of the protrusion 27 and forms a moat-like region. Owing to the flexural properties of a bottle 10 formed from thermoplastic, grip pressure on the exterior surface 14 of the bottle 10 decorated with facets 24 compresses the protrusion 27 and causes localized concentric deformation about the protrusion 27 that further increases the contact area between the user hand the bottle 10. In still other embodiments, as best seen with respect to FIG. 3J in which the recess is adjacent to, but not surrounding a protrusion, the deformation caused by grip pressure is generally lateral between the protrusion and the adjacent recess. It is appreciated that the facets can all be of like shape and size, for example as shown for facet 24, or facets that vary as to relative size, shape, or a combination thereof. In some inventive embodiments, between 10 and 95 percent of the exterior surface 14 is decorated with multiple facets 24, or any of the variants thereof as shown in FIG. 3A-3J or 3L: 24A, 24B, 24C, 24D, 24E, 24F, 24G, 24H, 24I, 24J, or 24L, each alone, or in combination. The facets 24A-24J, and 24L enhance the grip of an inventive bottle 10 by and also contribute to a bottle design that uniquely differentiates a product contained therein and enhances consumer brand recognition relative to other alternative brands of a similar product.

FIGS. 3A-3K show various shapes of a discoid 24A (FIG. 3A), a trigonal pyramid 24B (FIG. 3B) or a square pyramid 24H (FIGS. 3H and 3K), a truncated pyramid 24C (FIG. 3C), a hemisphere 24D (FIG. 3D) or 24F (FIG. 3F), a cuboid 24E, 24G, 24I (FIGS. 3E, 3G, and 3I, respectively), a sinusoidal pyramidal (FIG. 3J), a recessed sinusoidal pyramidal (FIG. 3L and FIGS. 7-9), or a combination thereof. It is appreciated that other polygonal shaped facets with 3 to 10 sides or operative herein.

Figure 4A:
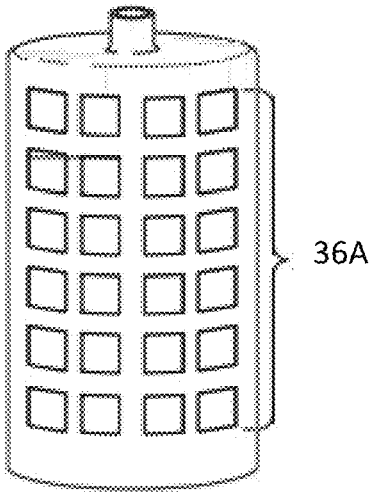
FIGS. 4A-4D are perspective views of various patterns of discrete facets integrally formed into an exterior surface of the bottle in accordance with embodiments of the invention.
Figure 4B:
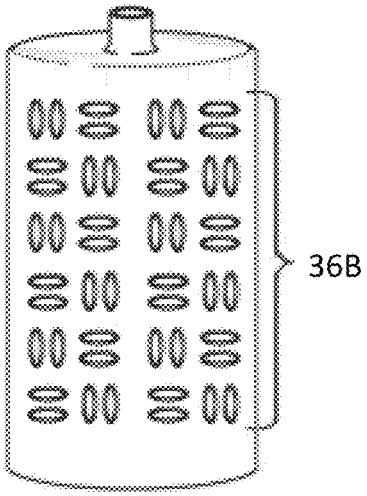
Figure 4C:
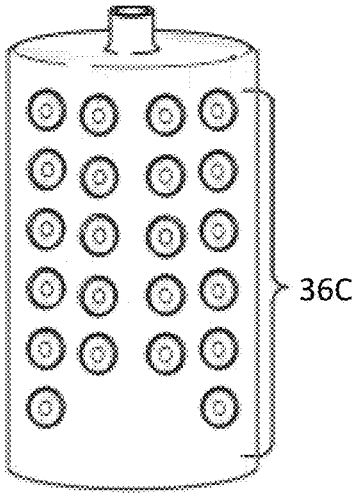
Figure 4D:
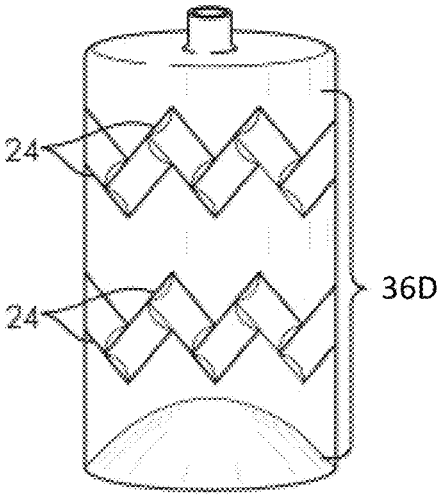

FIGS. 4A-4D show representative patterns 36 formed of facets according to the present invention, though it is appreciated that other patterns not shown are contemplated and incorporated into this disclosure. In some inventive embodiments, the pattern: 36A is polygonal defined by a regular polygon having n sides, n being an integer from 3 to 10 (illustrative example shown in FIG. 4A), 36B elliptical (FIG. 4B), 36C circles (FIG. 4C), and 36D contiguous facet wave (FIG. 4D). As shown in FIG. 4B, the facets can be paired or otherwise combined into groupings of 3 to 30 facets to create subunits. In some inventive embodiment, as shown in exemplary form in FIG. 4B, the subunits are in turn arranged to form a pattern.

Figure 5:
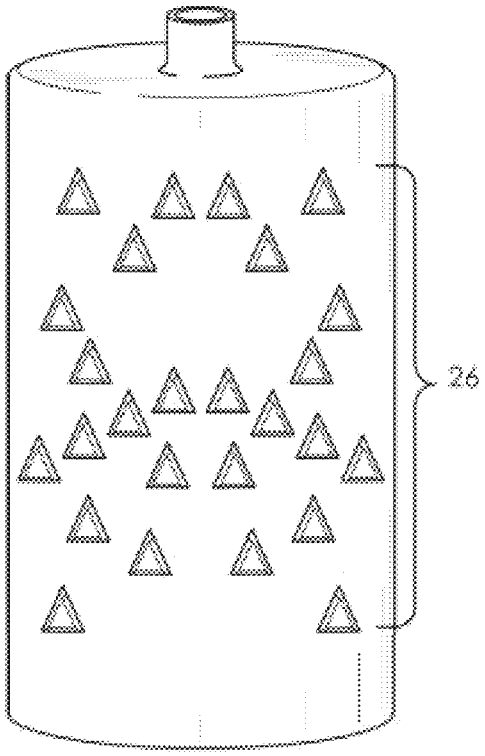
FIG. 5 is a perspective view of nonordered discrete facets integrally formed into an exterior surface of the bottle in accordance with an embodiment of the invention.

As shown in FIG. 5, the facets are nonordered or arranged to form indicia such as a logo, text or numerals.

Figure 6:
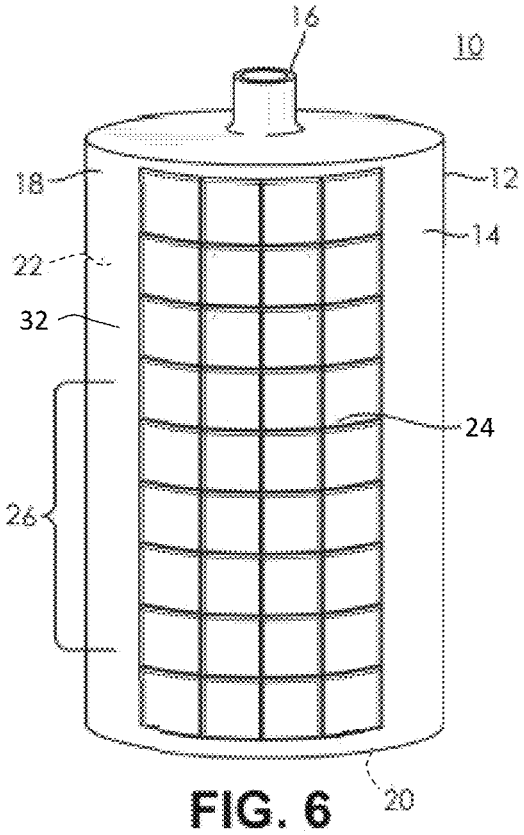
FIG. 6 is a perspective view of particular bottle having a neck portion and contoured in accordance with an embodiment of the invention.
Figure 7:
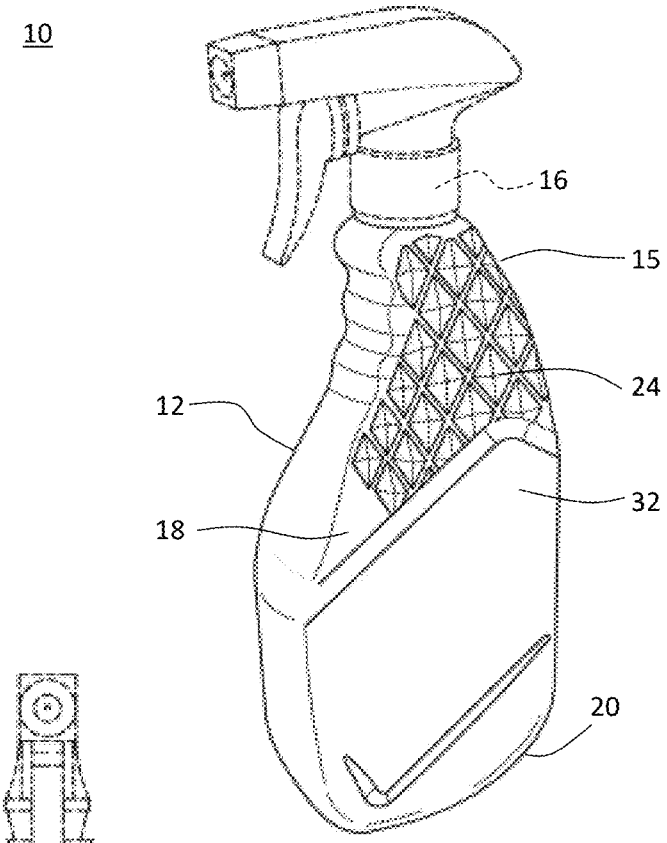
FIG. 7 is a perspective view of a bottle having contiguous discrete facets integrally formed with an exterior surface of the bottle and defining a space filling array in accordance with an embodiment of the invention.
Figure 8:
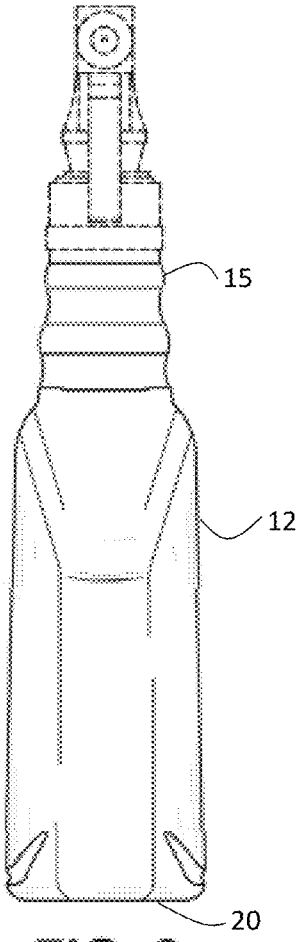
FIG. 8 is a front view of the bottle of FIG. 7.
Figure 9:
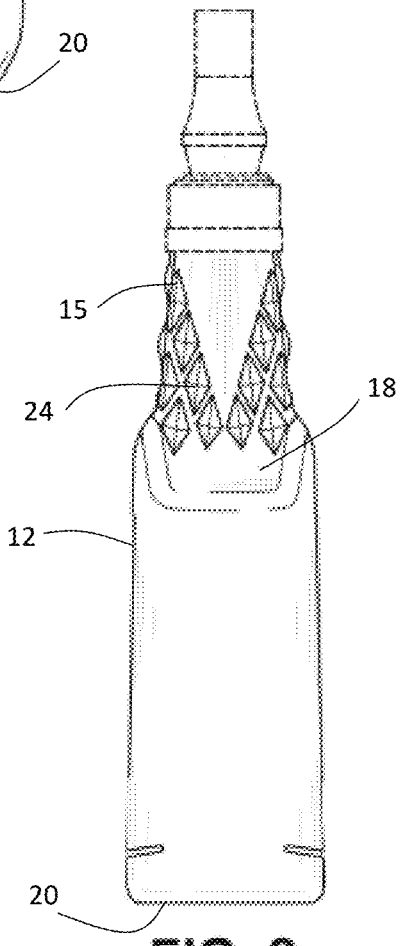
FIG. 9 is a back view of the bottle of FIG. 7.
Figure 12:
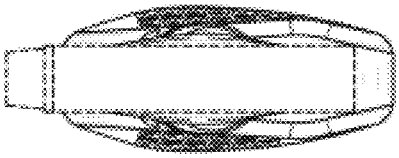
FIG. 12 is a top view of the bottle of FIG. 7.
Figure 13:
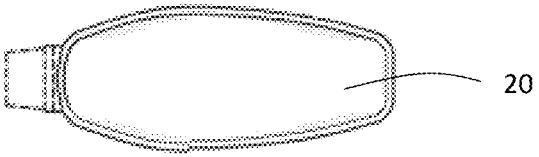
FIG. 13 is a bottom view of the bottle of FIG. 7.
Figure 10:
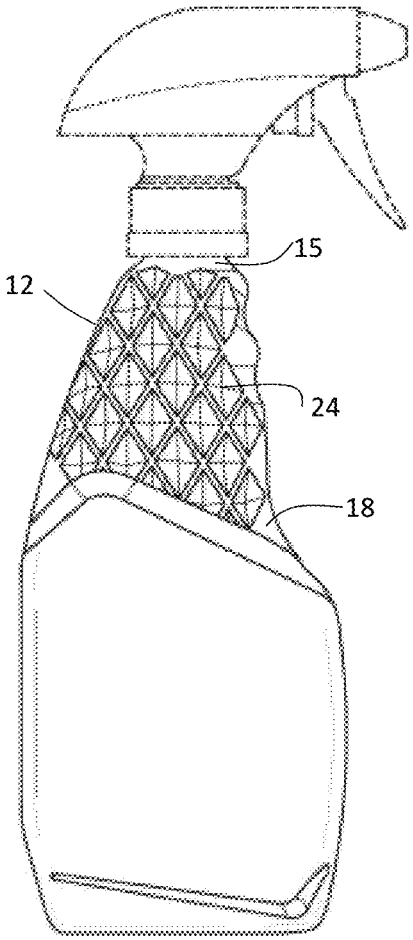
FIG. 10 is a left side view of the bottle of FIG. 7.
Figure 11:
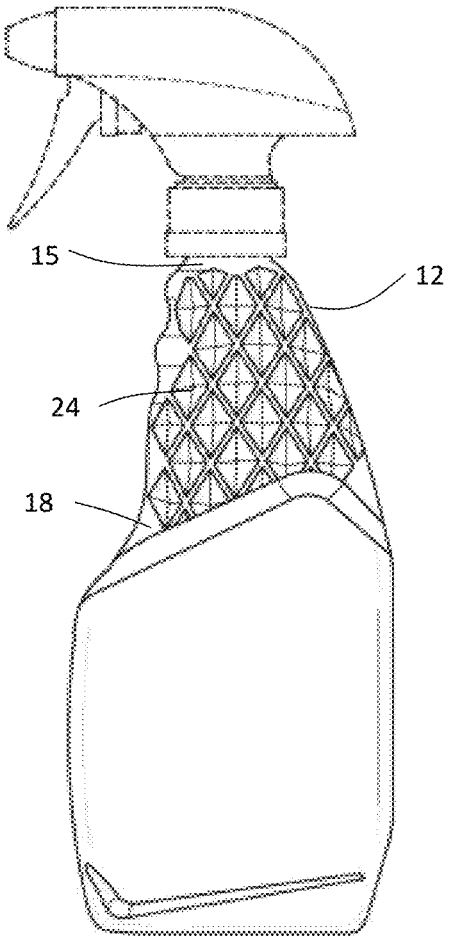
FIG. 11 is a right side view of the bottle of FIG. 7.

FIG. 6 shows contiguous facets forming a surface filling array in which the recess on two orthogonal sides of a facet rise to join the protrusions of an adjacent facet, akin to the topography of egg crate foam.

FIGS. 7-13 show continuous facets of FIG. 3L forming a surface filling array over a neck 15 portion intended to be gripped by a user palm in perspective view (FIG. 7), front (FIG. 8), back (FIG. 9), left side (FIG. 10), right side (FIG. 11), top (FIG. 12) and bottom (FIG. 13) views. The pump spray head is shown in ghost and is intended to only provide context for the present invention.

An inventive bottle is used in the application of an after-market vehicle maintenance fluid. Typically, such fluids contain surfactants or are lipophilic resulting in any surface coated with such a fluid becoming slippery when dripped. After allowing the drippage to seep into recesses of the facets, gripping the bottle is improved relative to a conventional bottle.

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient roadmap for implementing the exemplary embodiment or exemplary embodiments. It should be understood that various changes may be made in the function and arrangement of facets without departing from the scope as set forth in the appended claims and the legal equivalents thereof.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The invention claimed is:

1. An oblong thermoplastic bottle comprising:

a sidewall having an exterior surface that defines a plane curve;

said sidewall joined with a noncircular base and a selectively sealable mouth to define an interior volume; and a first plurality of facets integrally formed in said sidewall proximal to the sealable mouth, each of said plurality of facets having a recess interior to the plane curve and surrounding a protrusion extending above the recess, the protrusion having a peak and formed of planar angled faces that join at the peak.

2. The bottle of claim 1 further comprising a second plurality of facets formed in said sidewall that vary from said first plurality of facets as to shape, size, or a combination thereof.

3. The bottle of claim 1 wherein said first plurality of facets have a shape that is polygonal with 3 to 10 sides.

4. The bottle of claim 1 wherein said first plurality of facets alone, or in combination with a second plurality of facets formed in said sidewall that vary from said first plurality of facets as to shape, size, or a combination thereof define a pattern or an array.

5. The bottle of claim 1 wherein said first plurality of facets is nonordered.

6. The bottle of claim 1 wherein said first plurality of facets form indicia.

7. The bottle of claim 1 wherein one of said first plurality of facets has an area of between 0.9 and 300 square millimeters.

8. The bottle of claim 1 wherein one of said first plurality of facets has a height of between 1 and 4 millimeters.

9. The bottle of claim 1 wherein said recess of one of said first plurality of facets has a depth in a ratio relative to an absolute value of a height of said protrusion of between 0.2:1 and 5:1.

10. The bottle of claim 1 wherein one of said first plurality of facets defines a unit cell.

11. The bottle of claim 1 wherein at least two of said first plurality of facets are contiguous to one another.

12. The bottle of claim 1 wherein the exterior surface between at least two of said first plurality of facets forms a channel therebetween.

13. The bottle of claim 12 wherein said channel has a width of between 10 and 25 millimeters.

14. The bottle of claim 1 wherein the bottle, including said first plurality of facets, alone or in combination with a second plurality of facets formed in said sidewall that vary from said first plurality of facets as to shape, size, or a combination thereof has a bottle exterior surface area that is between 10 and 60 percent greater than a like bottle having a smooth exterior surface independent of facets.

15. The bottle of claim 1 further comprising an after-market vehicle maintenance fluid in said interior volume.

16. A method of applying an after-market vehicle maintenance fluid comprising:

removing a fluid from the volume of the bottle of claim 1 with drippage of the fluid on the exterior surface;

allowing the drippage to seep into recesses of said first plurality of facets; and gripping the bottle thereafter.

17. The method of using the bottle of claim 16 with instructions how to dispense an after-market vehicle maintenance fluid therefrom.

18. An oblong thermoplastic bottle comprising:

a sidewall having an exterior surface that defines a plane curve;

said sidewall joined with a noncircular base and a selectively sealable mouth to define an interior volume; and a first plurality of facets integrally formed in said sidewall proximal to the sealable mouth, each of said plurality of facets having a recess interior to the plane curve and surrounding a protrusion extending above the recess, the protrusion having a peak and formed of planar angled faces that join at the peak; and wherein said first plurality of facets integrally formed in said sidewall over a neck portion of the oblong bottle.

19. An oblong thermoplastic bottle comprising:

a sidewall having an exterior surface that defines a plane curve;

said sidewall joined with a noncircular base and a selectively sealable mouth to define an interior volume; and a first plurality of facets integrally formed in said sidewall proximal to the sealable mouth, each of said plurality of facets having a recess interior to the plane curve and surrounding a protrusion extending above the recess, wherein the protrusion has a pyramidal shape having a peak and formed of planar angled faces that join at the peak.

* * * * *